US005967676A

United States Patent [19]

Cutler et al.

[11] Patent Number: 5,967,676

[45] Date of Patent: Oct. 19, 1999

[54] IMAGE ORIENTATION SYSTEM FOR DISK PRINTING

[75] Inventors: Gerald Cutler, Santa Clara; Corwin Nichols, Palo Alto; Mark Soldan, Redwood City, all of Calif.

[73] Assignee: Microtech Conversion Systems, Inc., Belmont, Calif.

[21] Appl. No.: 09/052,704

[22] Filed: Mar. 31, 1998

[51] Int. Cl.[6] ..... B41J 3/42

[52] U.S. Cl. ..... 400/70; 101/35

[58] Field of Search ..... 400/120.16, 70; 101/35

[56] References Cited

U.S. PATENT DOCUMENTS

| | | | |
|---|---|---|---|
| 4,202,631 | 5/1980 | Uchiyama et al. | 356/394 |
| 4,270,863 | 6/1981 | Trogdon | 356/71 |
| 4,393,386 | 7/1983 | Di Giulio | 346/75 |
| 4,579,455 | 4/1986 | Levy et al. | 356/394 |
| 4,691,231 | 9/1987 | Fitzmorris et al. | 358/106 |
| 5,181,081 | 1/1993 | Suhan | 356/394 |
| 5,317,337 | 5/1994 | Ewadlt | 346/1.1 |
| 5,518,325 | 5/1996 | Kahle | 400/70 |
| 5,542,768 | 8/1996 | Rother et al. | 400/120.16 |
| 5,724,197 | 3/1998 | Barnes et al. | 359/824 |
| 5,781,221 | 7/1998 | Wen et al. | 347/232 |
| 5,797,688 | 8/1998 | Wen | 400/48 |
| 5,846,632 | 12/1998 | Chen et al. | 428/195 |
| 5,854,175 | 12/1998 | DeBoer et al. | 503/227 |

*Primary Examiner*—Edgar Burr
*Assistant Examiner*—Charles H. Nolan, Jr.
*Attorney, Agent, or Firm*—Law Offices of Terry McHugh

[57] ABSTRACT

A method and system for printing new material onto a designated area of a randomly oriented data storage substrate involves determining the orientation of the data storage substrate and electronically generating printer data that compensates for the specific orientation of the substrate. The preferred printing system includes an imaging device, a printing device, and a computer system. The printing method involves imaging a randomly oriented target substrate, such as an optical disk, having a visible pattern and a designated area for receiving new printed material. The new material, text and/or graphics to be printed onto the target disk, is normally oriented in a reference position, but, in order to account for the randomly oriented nature of the target disk, the orientation of the new material is electronically adjusted relative to the printing system. The electronically adjusted new material is then printed onto the designated area of the target disk without having to rotate the disk.

34 Claims, 7 Drawing Sheets

IMAGE ORIENTATION SYSTEM FOR DISK PRINTING

TECHNICAL FIELD

The invention relates generally to printing onto data storage substrates such as compact disks, and more specifically to printing onto disks having orientations that are random with respect to a print device. The invention also relates to measuring the quality of an image that has been printed onto a disk.

BACKGROUND ART

Optical disks are a common medium for use with data storage devices. Optical disks typically have data patterns embedded on one side of the disk, designated the bottom side, and eye-visible patterns printed on the other side of the disk, designated the top side. The printed patterns on the top side of a disk are typically in the form of text and/or graphics that present information related to the embedded data that is stored on the bottom side of the disk or relating to the source of the disk. Traditionally, optical disks have contained read only memory (ROM) in which the embedded data patterns on the bottom side of the disk do not change. Since the embedded data on the bottom side of the disk does not change, the text and/or graphics present on the top side of the disk may be printed one time only, with all of the text and/or graphics included in the single printing session. However, there are applications in which it is desirable to have two or more non-overlapping print sessions that generate eye-visible material on such disks.

Moreover, writeable optical disks and disk drive systems have been developed that allow a disk to be written with new embedded data after the initial production of the disk. With new data being embedded on the bottom side of the disk, there is a need to print new related text and/or graphics on the top side of the disk. In many cases the disk already has some text and/or graphics printed on the top side, and as a result, new text will only be appropriately located on certain areas of the disk. In addition, the pre-printed visible material often has a particular orientation, including rotation and translation components, that dictates the acceptable orientation of new visible material that is to be printed. When loading a large group of pre-printed disks into a printing device, it is difficult and time-consuming to manually align the pre-printed patterns of each disk so that the printer will print the new material in the same designated area of each successive disk.

A known solution to the problem of aligning pre-printed disks to avoid printing misaligned material involves placing a visible reference mark on each disk. The reference marks are used to align disks relative to a printer during each printing of visible material onto the disks. Specifically, an optical sensor is used to locate the reference mark on a disk. The disk is mechanically rotated until the reference mark is positioned such that the orientation of the pre-printed pattern on the disk is properly aligned with a printing device. The properly aligned disk is then imprinted with the new material such that the new material is located in the designated area of the disk and properly oriented with the pre-printed material on the disk.

Disadvantages of the above-described technique are that extra effort is required to print the reference mark on-the disk and that the reference mark creates a permanent blemish on the disk. An additional disadvantage is that mechanically rotating a disk requires additional equipment that would not be necessary if the rotational position of the disk were not changed.

There is also known prior art related to the problem of aligning randomly oriented CD-ROM disks that are to be loaded into protective sleeves or jewel cases. The known solution involves imaging a perfectly oriented disk and generating reference image data from the perfectly aligned disk. The reference image data is then compared to image data generated for a disk just before the disk is loaded into its protective sleeve. Based on the comparison, the target disk is mechanically rotated until the disk is properly oriented and then the disk is placed into its respective sleeve.

Once new material has been printed onto a disk, it is desirable to check the quality of the printed image. A system for checking the quality of a printed image on an optical disk is disclosed in U.S. Pat. No. 5,181,081, entitled "Print Scanner," issued to Suhan. Although Suhan discloses a system for checking the quality of a printed image, Suhan is only able to check the quality of the complete image on a disk by comparing the image to another complete image taken from a different disk. As a result, if the initial image has a printing defect, the defect becomes part of the reference image. In addition, Suhan is only able to check the quality of images that have the exact same orientation with respect to the printing and imaging apparatus.

As a result of the stated shortcomings, what is needed is a system and method for printing new textual and/or graphical material into a designated area of a randomly oriented and pre-printed substrate that does not require the substrate to have extraneous markings and that does not require the substrate to be mechanically rotated for printing. In addition, what is needed is a system and method for checking the quality of a newly printed disk that contains new visible material and pre-printed visible material.

SUMMARY OF THE INVENTION

The invention is a method and system for printing new visible material onto a designated area of a randomly oriented data storage substrate that involves determining the orientation of the data storage substrate and electronically generating printer data that compensates for the specific orientation of the substrate. The preferred printing system includes an imaging device, a printing device, and a computer system. The preferred printing method involves imaging a randomly oriented target substrate having a visible pattern and a designated area for receiving new printed material. The new material, text and/or graphics to be printed onto the target substrate, is normally oriented in a reference position, but, in order to account for the randomly oriented nature of the target substrate, the orientation of the new material is electronically adjusted in both rotation and translation relative to the printing system. The electronically adjusted new material is then printed onto the designated area of the target substrate without rotating the target substrate.

In a preferred embodiment, the method and system are utilized to print new material onto randomly oriented data disks, such as optical disks, that have been pre-printed with some material. Before production printing can begin, a learning process must be completed. The learning process involves first imaging a master disk which contains a pre-printed pattern that is similar to, and preferably the same as, pre-printed patterns on subsequent disks that will receive new printed material. Electronic image data representative of the imaged pattern on the master disk is created by the imaging system.

The computer system identifies the geometric center of the master disk. If the master disk is not initially placed in the printing device in a "normal" orientation (i.e. text reading left to right, etc.), the imaged master disk is electronically rotated by an operator to the "normal" orientation and the new orientation is used to create the disk image data.

Using the disk image data as a template, an area (or areas) relative to the disk's center or boundary, is identified by an operator via the computer system as an area to receive new material. The stored combination of disk image data and the identified area to receive new material becomes the master image data. The master image data, which is stored in the computer system, allows the orientation of subsequent randomly oriented disks to be identified and indicates where subsequent new material should be located on each randomly oriented disk relative to the disk's geometric center or boundary.

Upon completion of the learning process, production printing can begin. In order to print on a randomly oriented target disk, the existing pattern on the target disk is imaged by the imaging system and electronic image data is created. The image data of the target disk is then electronically compared to the master image data that is stored in the computer system. In one embodiment, strings of pixel values taken from similar locations in the master image data and the target image data are compared. The comparison enables the computer system to determine the orientation of the target image data relative to the master image data and thereby determine the position of the target disk relative to the printing device.

Knowing the orientation of the target disk relative to the printing device enables the computer system to generate printer image data that causes the new material to be printed into the designated area of the target disk without having to move or rotate the target disk. Printer image data is generated by calculating the translational and rotational adjustments necessary to print the new material into the designated area of the target disk. Finally, the new material is printed into the designated area of the target disk according to the newly created printer image data which has been transformed to incorporate the necessary translational and rotational adjustments. The orientation determination, print image transformation, and printing process is repeated for each successive disk that is to be printed.

In addition to printing, the system also has a quality assurance function. To perform quality assurance, a target disk is imaged after new material has been printed onto the disk. Image data is created that is representative of the post-printed target disk. The image data is compared to electronically generated quality assurance image data, and a measure of the quality of the post-printed target disk is generated by comparing the post-printed image data to the master quality assurance image data. The master quality assurance image data is created by combining the master image data with the new material to generate a complete data set that electronically represents the data set of an ideally printed disk.

Advantages of the invention include that the disks do not need reference marks to identify their orientation and that the disks do not need to be rotated to correct for the randomly oriented nature of the pre-printed patterns. In addition, since some printing is performed "pre-production" on faster and less expensive silk screening machines, the overall time to print a custom or one of a kind disk is greatly reduced. Another advantage includes that high quality generic text and/or graphics can be pre-printed with more sophisticated silk screening machines and the custom or one of a kind data, single color text, can be printed at a later time as needed.

DETAILED DESCRIPTION

Figure 1:
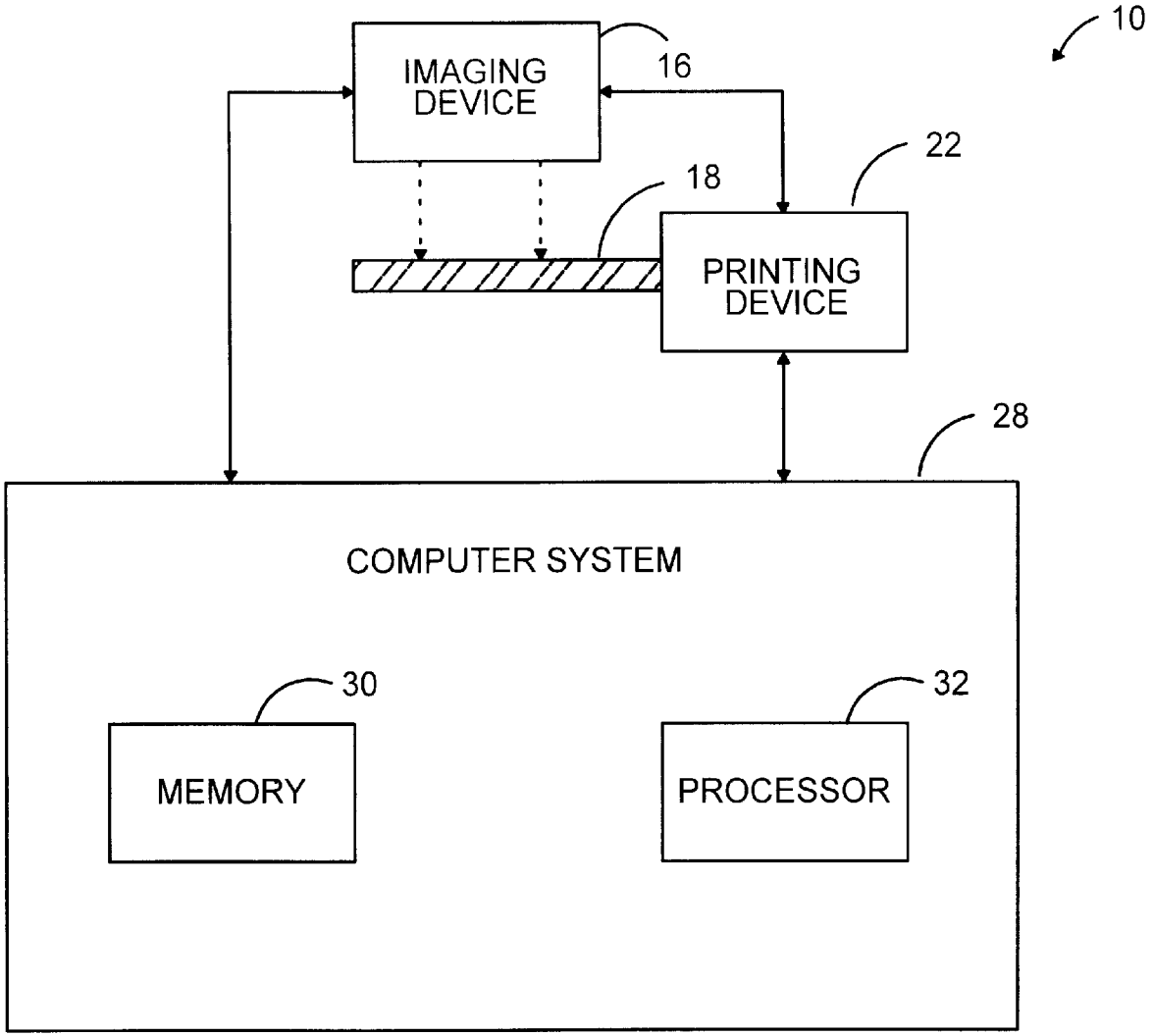
FIG. 1 is a depiction of a printing system in accordance with the present invention.

Referring to FIG. 1, the preferred printing system 10 includes an imaging device 16, a printing device 22, and a computer system 28. The system is utilized to print text and/or graphics onto a substrate, typically a compact disk (CD), a DVD, or an equivalent, in a particular location and orientation with respect to the geometry of a normalized disk. The new material is printed without having to rotate the disk. The terms substrate and optical disk are meant to include CDs, CD-ROM, CD-R (recordable), CD-RW (rewriteable), DVD, DVD-ROM, DVD-RAM, DVD-R, and any future form or format of a data storage substrate.

The printing device 22 is preferably a conventional printing device, such as a thermal printer (e.g., a thermal wax-transfer printer) or a bubble jet printer, that is able to print on the top side of an optical disk. However, the printing device may be an automated applicator of a decal or a label. Preferably, the printer has a disk handling system 18 that allows disks to be automatically fed into the printer upon command. For example, the disk handling system may include a printer tray and an automated pick and place machine that loads and unloads the printer tray.

The imaging device 16 may be a device such as a camera or a scanner. For example, a digital camera array may be used, although the type of imaging device is not critical to the invention. The imaging device must be able to capture an image of the top side of a substrate such as a CD and generate electronic data that is reflective of the image on the CD, and the device must have a pixel density that provides sufficient image resolution. Preferably, the imaging device is rigidly mounted above the disk handling system such that it can image a disk that is located in the disk handling system 18. As will be discussed further, an image of a disk is required before the disk is printed with new material. In order to perform quality control, an image of a disk is also needed after the disk is printed with new material and, therefore, in some printer arrangements, more than one imaging device may be needed. Preferably, if the printer outputs the printed disk to the same location where it accepted the incoming disk, only one imaging device is needed.

The computer system 28 is a system that includes a graphical user interface, memory 30, and a processor 32. The computer system is able to store imaging data that is generated by the imaging device, text and/or graphics that are specified by the user, and various software routines, including routines that compare sets of image data and that determine proper translation/rotation requirements for new material. The computer system is electronically connected to the imaging device 16 and to the printing device 22, so that data can be freely transferred back and forth between devices. Any appropriate data transfer protocol may be utilized for data transfer between the devices.

Although the imaging device 16, the printing device 22, and the computer system 28 are depicted and discussed as separate devices, any or all of the devices may be integrated to form multipurpose devices. For example, the imaging device and printing device may be integrated into a single unit. The exact integration and/or orientation of the devices is not critical to the invention as long as the functions are appropriately formed.

Figure 2:
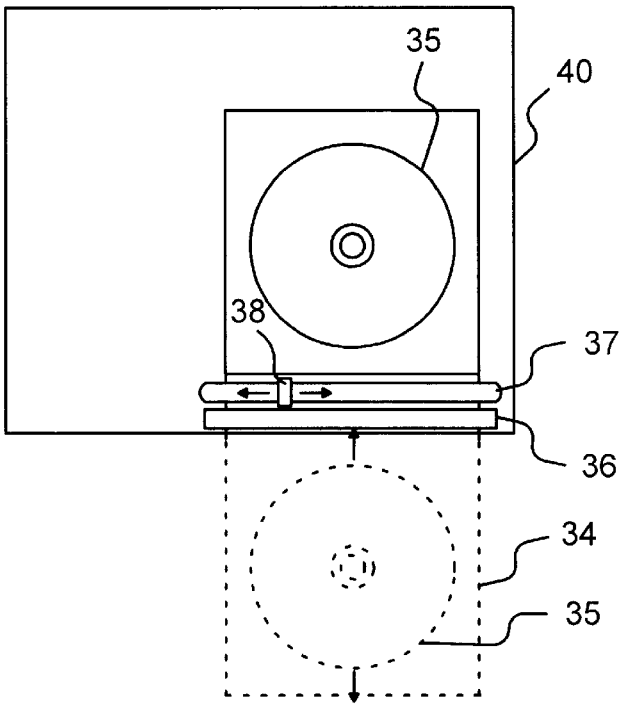
FIG. 2 is a depiction of an alternative embodiment of the printing system integrated with a recording device, a CCD scanner, and a translating head printer in accordance with the invention.
Figure 3:
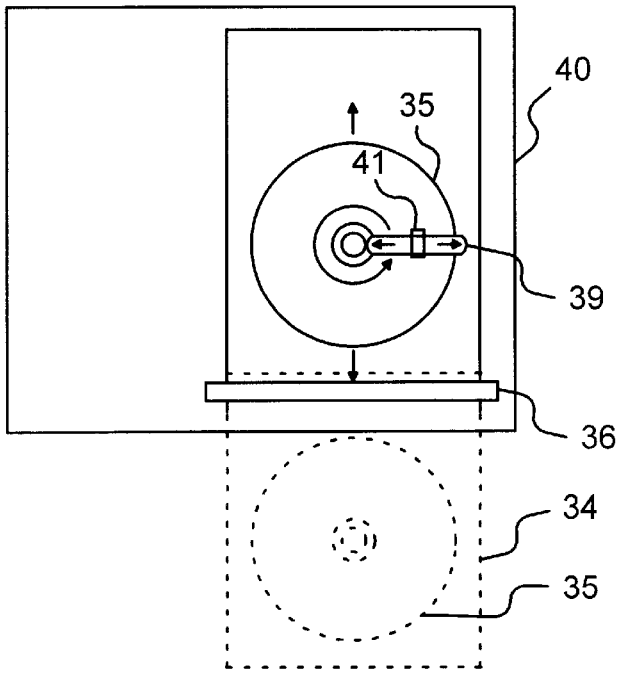
FIG. 3 is a depiction of an alternative embodiment of the printing system integrated with a recording device, a CCD scanner, and a translating head printer in accordance with the invention.

FIGS. 2 and 3 represent alternative embodiments of the printing system 10 of FIG. 1 that include a CD recording device integrated with the printing system. In the alternative embodiment of FIG. 2, a disk tray 34 is integrated with an imaging device 36, a printing device 37, and a CD recording device 40. In the embodiment, the imaging device is a CCD array scanner with a pixel array that is large enough to image the entire diameter of a disk 35. The printing device includes a translating head printer having a printing head 38 that can span the entire diameter of a disk.

The embodiment of FIG. 2 operates by placing a disk 35 in the handling tray 34 and moving the tray into the CD recorder 40 past the scanner and the translating head printer. The scanner scans the disk as the disk enters the CD recorder and an image is printed on the disk as the disk passes the translating printer head 38. The system can be set-up to either print on the disk as the disk enters the CD recorder or as the disk is removed from the CD recorder.

In the alternative embodiment of FIG. 3, the translating head printer 39 has a printer head 41 that can only span one-half of the diameter of a disk 35. The scanner 36 scans the disk as the disk enters the CD recorder 40 and the printer head prints on the disk while the disk is located within the CD recorder. Preferably, printing on the disk occurs while the disk is in the same position as the disk is in for recording.

Figure 4:
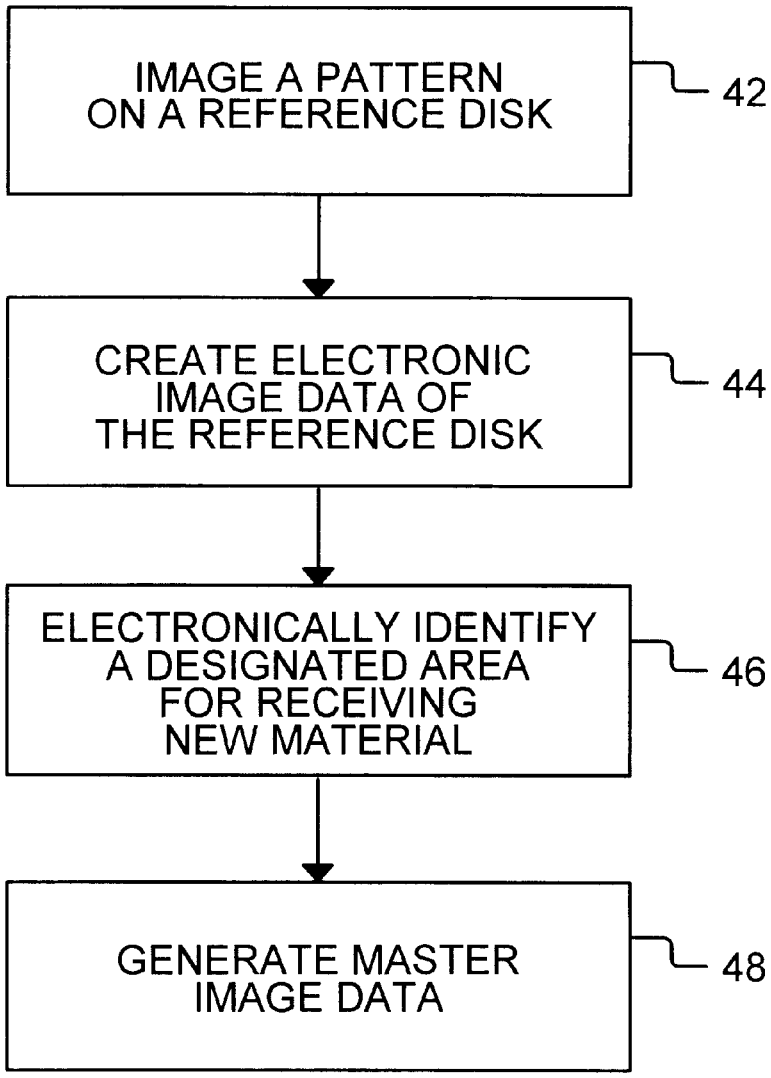
FIG. 4 is a process flow of the learning process in accordance with the invention.
Figures 5A, 5B, 5C, 5D:
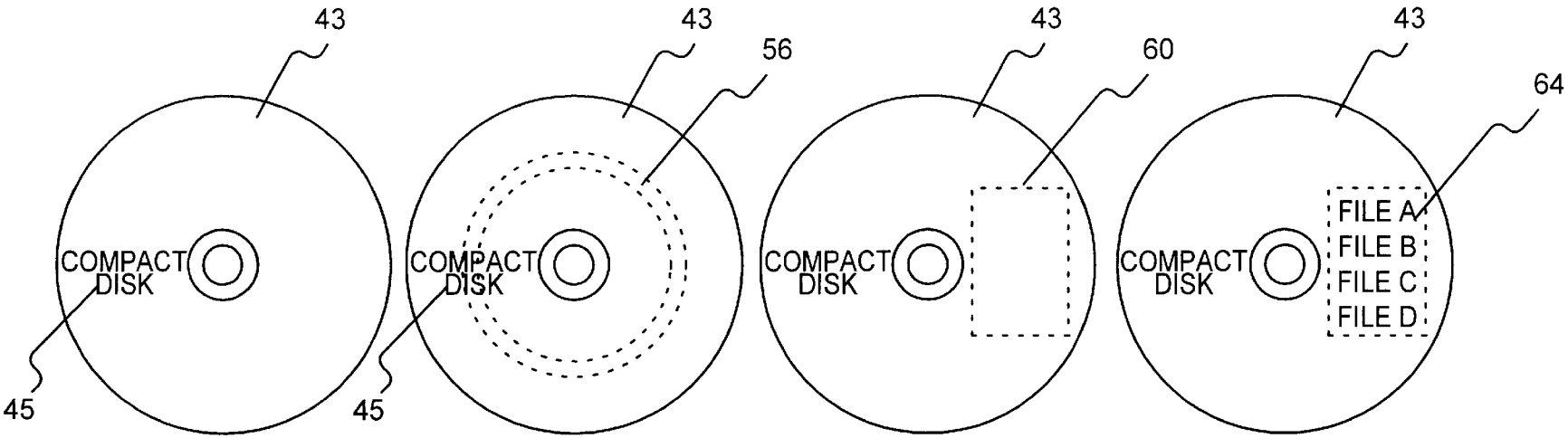
FIG. 5A is a depiction of a pre-printed optical disk.
FIG. 5B is a depiction of a circular band of image data that is used to create master image data in accordance with the invention.
FIG. 5C is a depiction of an area on the master image data that is designated to receive newly printed material.
FIG. 5D is a depiction of an electronic image of the master disk after the new material is electronically placed into the designated area.

In a preferred embodiment, the system is utilized to print new visible material onto a series of randomly oriented disks, where all of the disks have the same textual and/or graphical images already printed on the disks. In order for the system to print properly, an initial learning process must be completed. FIG. 4 is a flow diagram of the learning process, and FIGS. 5A–5D are graphical representations of the learning process. To begin the learning process, one of the disks with the pre-printed image is loaded into the disk handling system. Referring to FIG. 4, in a first step 42, a pattern on a disk is imaged by the imaging device. As shown in FIG. 5A, the pre-printed image on the disk 43 may be a simple marking 45, such as the identifier "compact disk." The pre-printed disk becomes the master, or reference, disk and in a subsequent step 44, electronic image data representative of the imaged pattern is created and stored in the computer. The newly created electronic image data is then displayed on the computer system 28 of FIG. 1 and manipulated through the computer's graphical user interface. During the learning process, it is assumed that the master disk will not be in the same orientation as the randomly oriented disks that are to be printed later.

The newly created image data is manipulated by a user to electronically identify the orientation of a "normalized" disk. A normalized disk is defined as a disk that is oriented such that text and/or graphics are in their preferred viewing arrangement (i.e. text arranged left to right). A normalized disk is identified by either physically rotating the master disk in the printing tray such that the patterns on the disk are normalized or by electronically rotating the image of the master disk such that the patterns are normalized. If the disk image is electronically rotated, the computer system must first calculate the geometric center of the disk so that the disk can be rotated about its center point.

In a preferred embodiment, operational speed and memory usage are optimized by storing only a portion of the newly created image data. For example, the circular band 56 shown in FIG. 5B may be electronically designated by the user as the region from which image data is to be extracted and stored for subsequent use in determining the orientation of target disks. Of course, the designated region must include at least a portion of a distinguishing imageable feature, such as the identifier 45 "compact disk." Utilizing the circular band may include extracting the pixel data representing the circular band and creating a linear graph of pixel values. The linear graph of pixel values is compared to the linear graphs of equivalent bands of pixel data acquired in imaging subsequent disks to determine the rotational position of the subsequent disks versus the master disk. As an alternative, the entire body of image data may be stored for later use.

In addition to identifying the orientation information, in a next step 46 a user must electronically identify an area on the disk 43 that is designated for receiving new printed material. The area can be designated relative to patterns or features already present in the image of the master disk but the computer system represents the designated area as transitional and rotational components relative to the center of the disk. More than one area can be designated for receiving new printed material. For example, multiple areas may include designated corresponding titles and corresponding dates. FIG. 5C depicts the displayed image data with a dashed box 60 representing the designated area where new material is to be printed. The new material that is to be printed is supplied by the operator and may include newly entered text, database information, and/or previously prepared text and/or graphics. For example purposes, FIG. 5D depicts the electronic display of new material 64, in the form of text, that is to be printed onto the designated area of the target disks.

To complete the learning process, in a next step 48 master image data is generated. The master image data represents the normalized orientation of the master disk 43 and the identified designated area for printing new material relative to the geometric center of the normalized disk. The master image data is stored in the memory of the computer system for use during production printing.

Master image data may be stored in a database to create a digital library of master image data. With a library of master image data available, the learning process does not have to be repeated for the same type of disk and as a result small numbers of uniquely patterned disks can be efficiently processed.

Figure 6:
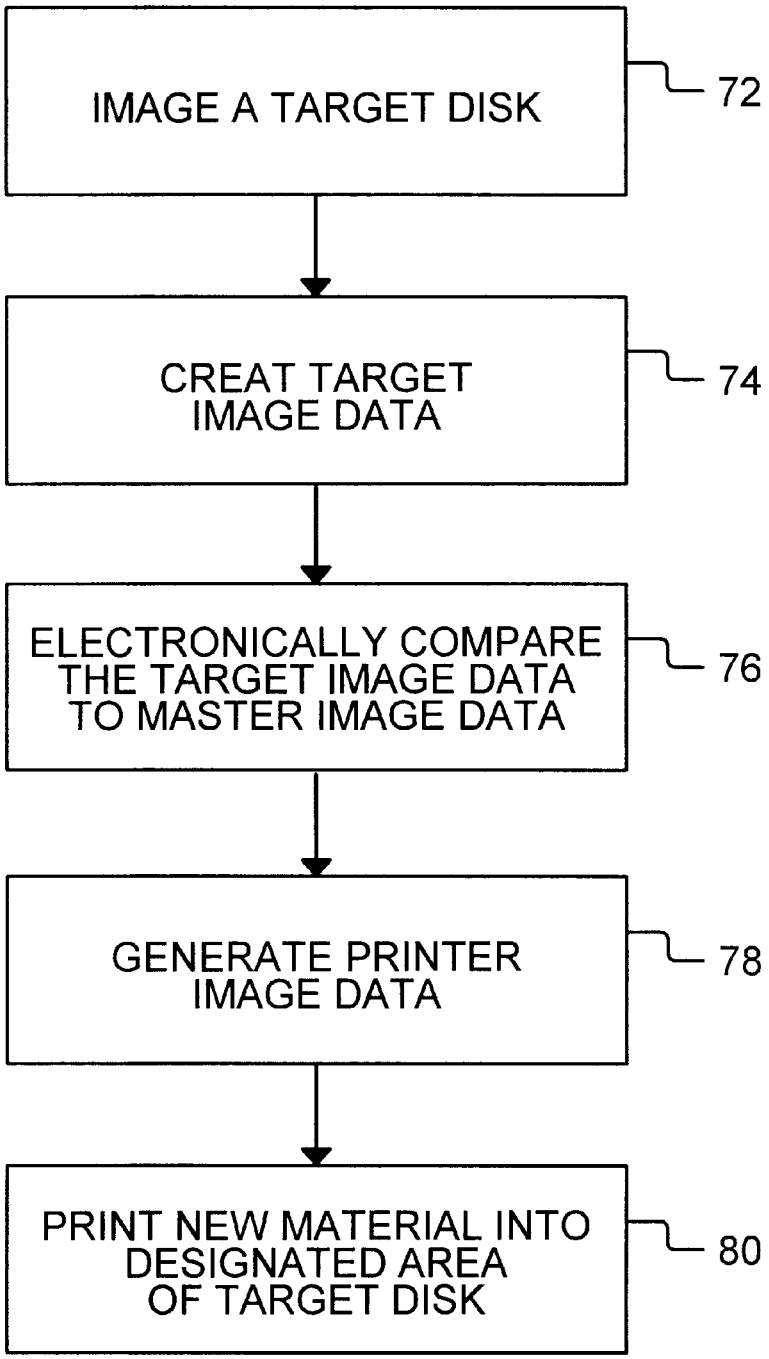
FIG. 6 is a process flow of the printing process in accordance with the invention.
Figure 7C:
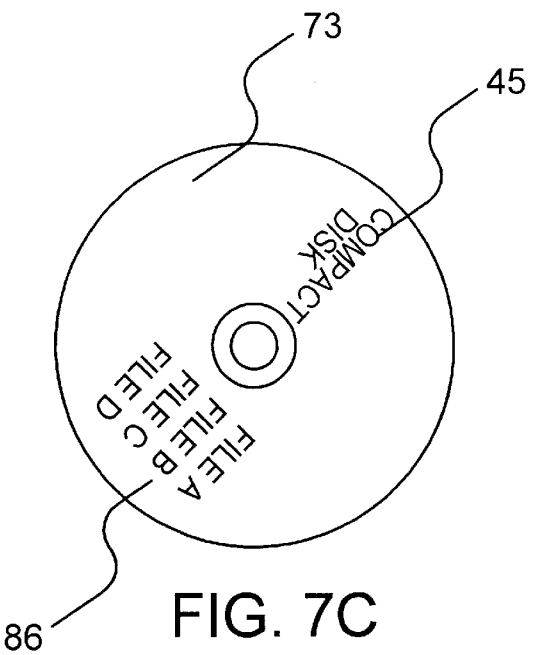
FIG. 7C is a depiction of a target disk after new material has been printed into the designated area.
Figure 7B:
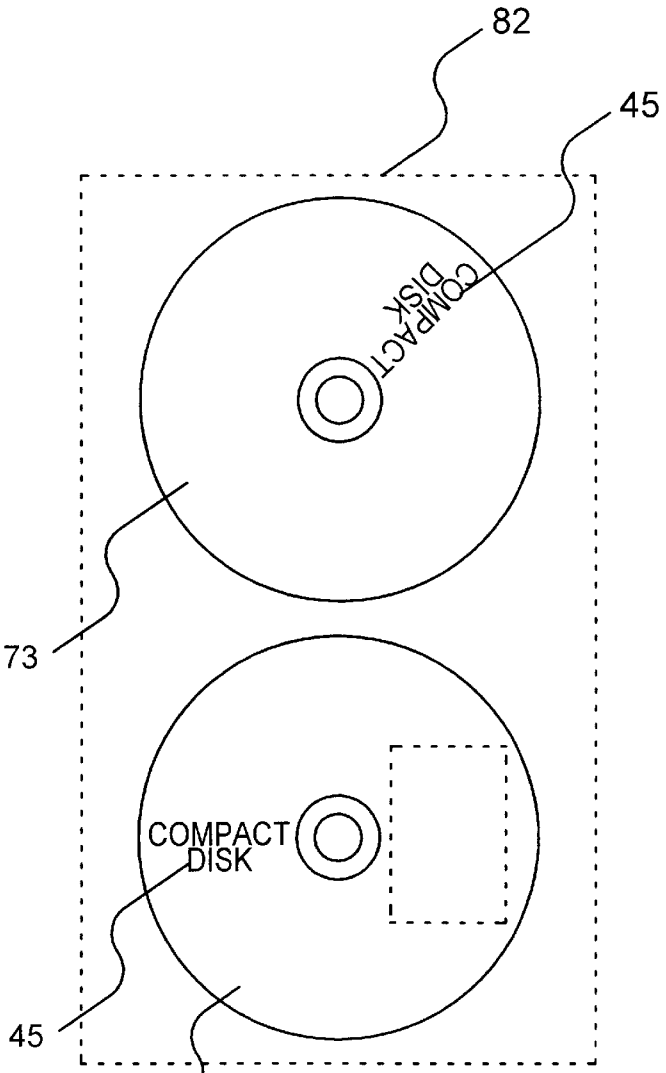
FIG. 7B is a depiction of the comparison between target image data and master image data.
Figure 7A:
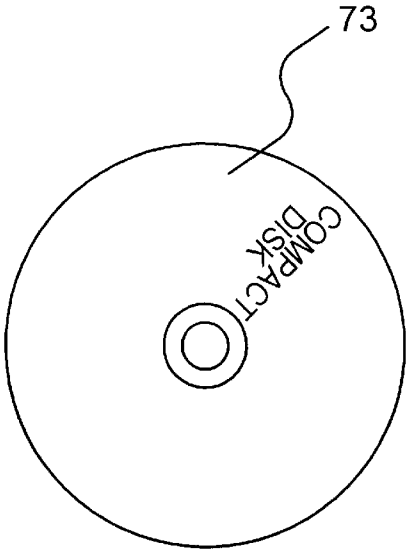
FIG. 7A is a depiction of a pre-printed and randomly oriented target disk.

After the learning process is complete, the system 10 is able to begin the production printing process. Typically, a group of similarly pre-printed disks is loaded into a disk handling cassette that is connected to the disk handling system 18. Referring to FIGS. 6 and 7, in a first step 72, a randomly oriented target disk is imaged by the imaging camera. As depicted in FIG. 7A, the target disk 73 has the same pattern pre-printed on the disk as the master disk 43 depicted in FIG. 5A, except that the target disk is randomly oriented compared to the master disk. In a next step 74, electronic image data of the target disk is created by the imaging device 16 and transferred to the computer system 28 for storage and/or computer s. In a next step 76, the computer system electronically compares the target image data representative of the target disk to the stored master image data, to determine the orientation of the target image data relative to the master image data. The comparison of the target image data relative to the master image data is represented by the dashed-line box 82 in FIG. 7B. In one embodiment, the comparison of the target image data to the master image data includes correlating the linear graph of pixel values representative of the features within the circular band 56 of FIG. 5B to a linear graph of pixel values representative of an identical circular band extracted from imaging the target disk. Specifically, the pixel values representing the identifier 45 along the surface of the target disk will be offset relative to the pixel values representing the same identifier along the surface of the master disk. A conventional software routine can compare the two pixel strings and derive the orientation of the target disk relative to the master disk, and more importantly relative to the printing device. The comparison process may include incrementally offsetting the two linear graphs of pixel values until a best fit is determined. An alternative method for determining the orientation of a target disk may include utilizing a feature recognition algorithm that identifies a particular feature on the target disk and determines the translation and rotation of the target disk relative to the master image data.

In an alternative embodiment, if the comparison between the target image data and the master image data finds that the pattern on the target disk does not conform to the pattern that was expected to be imaged, the non-conforming disk can be identified and/or removed from the printing process without being printed. The non-conforming disk can also be marked as a "reject" disk.

Once the orientation of the target disk 73 relative to the printing device 22 is determined, in a next step 78 the computer system 28 generates printer image data that enables new material to be printed into the designated area of the target disk regardless of the orientation of the disk. The printer image data is generated by conventional transformation algorithms that calculate the translational and rotational adjustments that must be made to the new material data file to enable the new material to properly print in the designated area of the target disk without adjusting the position of the target disk. Once the printer image data is generated, it is stored in the computer system and/or transferred to the printer.

Before the disk printing can begin, the target disk 73 must be loaded into position within the printer 22 and the printer image data must be available for use by the printer. With the disk loaded and the data available, in a next step 80, the printer prints the new material into the designated area of the target disk in accordance with the printer image data. The final printed image, as depicted in FIG. 7C, includes the pre-printed material 45 and the new material 86, with the new material being properly located and aligned within the designated area of the target disk. The new material is printed onto the disk properly without having moved or rotated the disk. The entire printing process including the orientation determination and the printer image data transformation, is repeated for subsequent disks, yet the learning process only needs to be repeated when there is a new pre-printed pattern or a new designated area on the target disks. As stated above, a digital library may be present that provides access to master image data that was previously generated, thereby eliminating the need to repeat the learning process in certain situations.

It should be noted that the printing of new material is not limited to one printing session. For example, in a system where disks are being used for incremental backups, it may be desirable to print multiple times on the same disk. The new material may include subsequent file names or dates ordered in a column by column nature.

Figure 8:
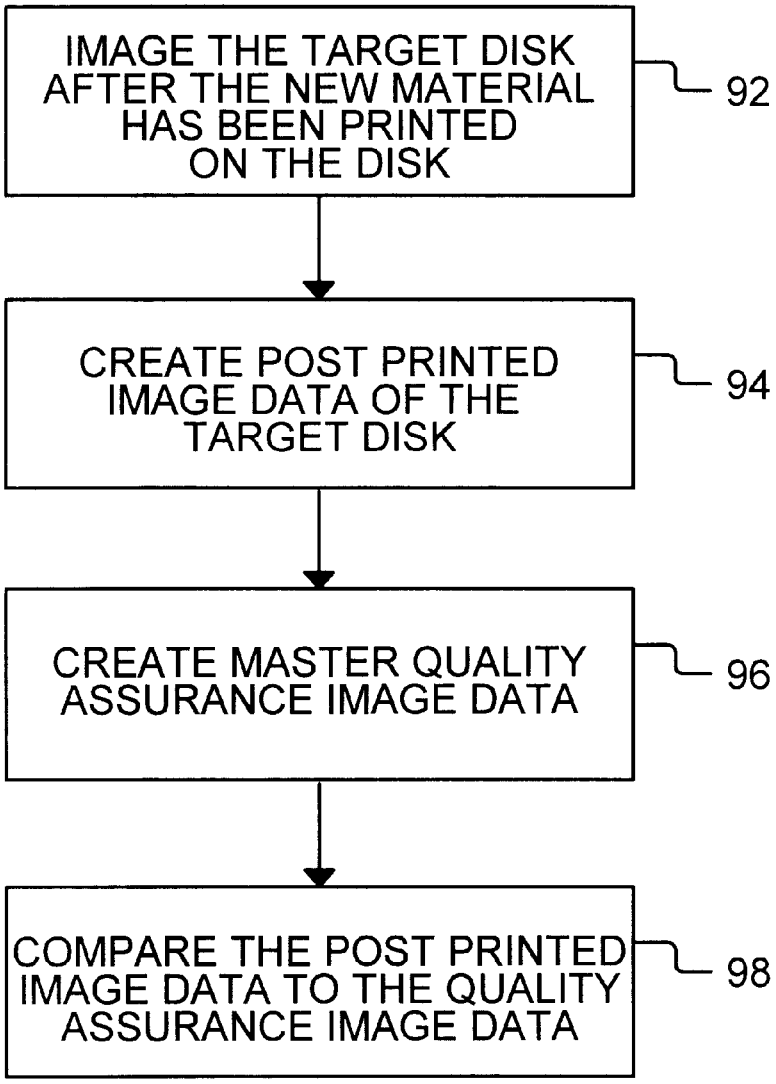
FIG. 8 is a process flow of the quality assurance process in accordance with the invention.

Upon completion of printing, a process of checking the quality of the printed product may be performed. Referring to FIG. 8, the quality assurance (QA) process involves a first step 92 of imaging the target disk after the new material has been printed onto the target disk. The post-printed disk may be imaged by the same imaging device that created the initial image or a different imaging device, depending on the physical design of the system. A next step 94 involves creating post-printed image data that is representative of the target disk after the new material has been printed on the target disk.

At step 96, the computer system creates master quality assurance image data by combining data files containing the master image data that was originally created from the master disk and the data file containing the new material data. By combining the two data sets, the master quality assurance image data is an electronically created data set that reflects an ideal post-printed disk.

To check the quality of an actual post-printed image on a disk, in a next step 98 the post-printed image data and the master quality assurance image data are electronically compared to identify differences. The difference between pixel values of the two data sets is correlated to a measure of the quality of the newly printed target disk. The measure of the quality can then be transmitted to a display on the computer system, stored in a database, or provided to the computer system as instant feedback that can be used to improve subsequent printing.

Although the invention involves utilizing optical imaging to determine the orientation of substrates, other means may be used to determine substrate orientation. For example, metal could be added to a part of the pre-printed material and an x-ray device could be used to determine substrate orientation. In another example, a substrate may have a detectable physical feature molded into the substrate that is used to determine substrate orientation.

Further, although the invention is described with reference to optical disks such as compact disks, other data storage substrates may be printed utilizing the same methods and systems. In addition, although the learning process describes the imaging of pre-printed patterns, other patterns on a disk may be used to identify the orientation of a substrate. For example, the substrate may have engraved markings such as serial numbers that can be imaged to determine relative orientation.

What is claimed is:

1. A method of printing new material into a designated area of a randomly oriented data storage substrate comprising the steps of:

determining the rotational orientation of a randomly oriented target substrate having a designated area for receiving new material, said new material being normally oriented in a reference position;

electronically adjusting said orientation of said new material that is to be printed onto said target substrate to correspond to said determined rotational orientation of said target substrate; and printing said new material into said designated area of said target substrate according to said electronically adjusted orientation of said new material.

2. The method of claim 1 further including a step of maintaining a rotational position of said target substrate relative to a printing system between said step of determining and said step of printing.

3. The method of claim 1 wherein said step of determining includes a step of imaging a visibly detectable pattern on said randomly oriented target substrate.

4. The method of claim 3 wherein said step of determining includes a substep of comparing image data from said target substrate to previously acquired master image data in order to determine said position of said target substrate to a printing system.

5. The method of claim 4 wherein said substep of comparing includes a substep of correlating pixel values of said target image to pixel values of said master image data.

6. The method of claim 1 wherein said step of electronically adjusting said orientation includes a step of electronically adjusting said new material in translation.

7. The method of claim 1 wherein said step of electronically adjusting said orientation includes a step of electronically adjusting said new material in rotation.

8. The method of claim 1 further including the initial steps of:

imaging a reference substrate having a visibly detectable pattern similar to a visibly detectable pattern of said target substrate;

electronically designating an area on said reference substrate for printing new material; and electronically generating master image data that is indicative of said visibly detectable pattern of said reference substrate and said designated area for printed new material.

9. The method of claim 1 further including the subsequent steps of:

creating quality assurance image data by electronically combining master image data representative of a visibly detectable pattern on a reference substrate and new material data that is electronically generated and stored in a data file;

imaging said target substrate after said new material has been printed into said designated area, thereby creating target substrate image data;

comparing said target substrate image data to said quality assurance image data; and generating a measure of quality of said newly printed target substrate.

10. A system for printing new eye-visible material onto a designated area of a data storage substrate comprising:

means for generating electronic data representative of an orientation of a data storage substrate;

means for storing master image data, target image data, new material data, and a library of processing routines, said storage means being in data transfer connection with said means for generating orientation data;

means for generating data to print new eye-visible material onto a designated area of said substrate in an orientation that corresponds to said orientation of said substrate without physically rotating said substrate, said means for generating print data being in data transfer connection with said means for storing and said means for generating orientation data; and means for printing said new eye-visible material onto said designated area of said data storage substrate, said means for printing being in data transfer connection with said means for storing and said means for generating printer data, and being in data storage substrate transfer connection with said means for generating orientation data.

11. The system of claim 10 further including a quality control means for generating a measure of the quality of said newly printed eye-visible materials.

12. The system of claim 10 wherein said means for printing includes a substrate handling system having a substrate path between said means for generating orientation data and said means for printing, said substrate path being fixed with respect to angular rotation of said data storage substrate.

13. A method of printing new material into a designated area of a randomly oriented and pre-printed substrate, comprising the steps of:

imaging a pattern on a target pre-printed substrate having a designated area for receiving new material;

creating target image data representative of said imaged pattern on said target pre-printed substrate;

electronically comparing said target image data representative of said target substrate to master image data to determine rotational orientation of said target image data relative to said master image data;

generating printer image data that enables said new material to be printed into said designated area of said target pre-printed substrate based upon said comparison between said target image data and said master image data; and printing said new material into said designated area of said target pre-printed substrate according to said generated printer image data.

14. The method of claim 13 wherein said step of electronically comparing includes a step of determining whether or not said target image data matches said master image data and a step of identifying said target substrate as non-conforming if said target image data does not match said master image data.

15. The method of claim 13 further including a step of maintaining the angular position of said target pre-printed substrate constant between said step of imaging a pattern on said target pre-printed substrate and said step of printing said new material.

16. The method of claim 13 wherein said step of comparing includes a substep of comparing pattern features from said target image data to pattern features from said master image data.

17. The method of claim 13 wherein said step of generating printer image data includes a substep of calculating necessary translation coordinates that are required to accurately print said new material into said designated area of said target pre-printed substrate.

18. The method of claim 13 wherein said step of generating printer image data includes a substep of calculating necessary rotation that is required to accurately print said new material into said designated area of said target pre-printed substrate.

19. The method of claim 13 including the initial steps of:

imaging a pattern of a master pre-printed substrate that has a similar pattern to said target pre-printed substrate;

creating electronic image data representative of said imaged pattern of said master pre-printed substrate;

electronically identifying said designated area for printing new material on said master pre-printed substrate; and generating said master image data that represents said identified designated area for printing new material on said master pre-printed substrate.

20. The method of claim 13 further including the steps of:

imaging said target pre-printed substrate after said new material has been printed onto said target substrate;

creating post printed image data representative of said target pre-printed substrate after said new material has been printed onto said substrate;

creating master quality assurance image data by combining electronic data representative of said new material with said master image data; and comparing said post printed image data to said master quality control image data to generate a measure of the quality of said newly printed target substrate.

21. A method of printing new material into a designated area of a randomly oriented data storage substrate comprising the steps of:

imaging a reference substrate having a visibly detectable pattern similar to a visibly detectable pattern of a randomly oriented target substrate;

electronically designating an area on said reference substrate for printing new material;

electronically generating master image data that is indicative of said visibly detectable pattern of said reference substrate and said designated area for said new material;

determining the orientation of said randomly oriented target substrate having a designated area for receiving said new material, said new material being normally oriented in a reference position;

electronically adjusting said orientation of said new material that is to be printed onto said target substrate to correspond to said determined orientation of said target substrate; and printing said new material into said designated area of said target substrate according to said electronically adjusted orientation of said new material.

22. The method of claim 21 further including a step of maintaining a rotational position of said target substrate constant relative to a printing system between said step of determining and said step of printing.

23. The method of claim 21 wherein said step of determining includes a substep of comparing image data from said target substrate to said master image data in order to determine a position of said target substrate relative to a printing system.

24. The method of claim 23 wherein said substep of comparing includes a substep of correlating pixel values of said target data image to pixel values of said master image data.

25. The method of claim 21 wherein said step of electronically adjusting said orientation includes a step of electronically adjusting said new material in translation.

26. The method of claim 21 wherein said step of electronically adjusting said orientation includes a step of electronically adjusting said new material in rotation.

27. The method of claim 21 further including the subsequent steps of:

creating quality assurance image data by electronically combining master image data and new material data;

imaging said target substrate after said new material has been printed into said designated area, thereby creating target substrate image data;

comparing said target substrate image data to said quality assurance image data; and generating a measure of quality of said newly printed target substrate.

28. A method of printing new material into a designated area of a randomly oriented and pre-printed substrate, comprising the steps of:

imaging a pattern of a master pre-printed substrate that has a similar pattern to a target pre-printed substrate;

creating electronic image data representative of said imaged pattern of said master pre-printed substrate;

electronically identifying a designated area for printing new material on said master pre-printed substrate;

generating master image data that represents said electronic image data representative of said imaged pattern of said master pre-printed substrate and said identified designated area for printing new material on said master pre-printed substrate;

imaging a pattern on a target pre-printed substrate having a designated area for receiving new material;

creating target image data representative of said imaged pattern on said target pre-printed substrate;

electronically comparing said target image data to said master image data to determine orientation of said target image data relative to said master image data;

generating printer image data that enables said new material to be printed into said designated area of said target pre-printed substrate based upon said comparison between said target image data and said master image data; and printing said new material into said designated area of said target pre-printed substrate according to said generated printer image data.

29. The method of claim 28 wherein said step of electronically comparing includes a step of determining whether or not said target image data matches said master image data and a step of identifying said target substrate as non-conforming if said target image data does not match said master image data.

30. The method of claim 28 further including a step of maintaining the angular position of said target pre-printed substrate constant between said step of imaging a pattern on said target pre-printed substrate and said step of printing said new material.

31. The method of claim 28 wherein said step of comparing includes a substep of comparing pattern features from said target image data to pattern features from said master image data.

32. The method of claim 28 wherein said step of generating printer image data includes a substep of calculating necessary translation coordinates that are required to accurately print said new material into said designated area of said target pre-printed substrate.

33. The method of claim 28 wherein said step of generating printer image data includes a substep of calculating necessary rotation that is required to accurately print said new material into said designated area of said target pre-printed substrate.

34. The method of claim 28 further including the steps of:

imaging said target pre-printed substrate after said new material has been printed onto said target substrate;

creating post printed image data representative of said target pre-printed substrate after said new material has been printed onto said substrate;

creating master quality assurance image data by combining electronic data representative of said new material with said master image data; and comparing said post printed image data to said master quality assurance image data to generate a measure of the quality of said newly printed target substrate.

* * * * *